United States Patent [19]

Cox

[11] 4,139,930

[45] Feb. 20, 1979

[54] ALL-METAL HAMMER HANDLE ADAPTER CONSTRUCTION

[76] Inventor: Charles T. Cox, 2224 Harwood, Royal Oak, Mich. 48067

[21] Appl. No.: 840,722

[22] Filed: Oct. 11, 1977

[51] Int. Cl.[2] ..... B25D 1/00
[52] U.S. Cl. ..... 145/29 R
[58] Field of Search ..... 145/29 R, 36, 29 B

[56] References Cited

U.S. PATENT DOCUMENTS

| | | | |
|---|---|---|---|
| 1,532,135 | 4/1925 | Gibbs | 145/36 |
| 1,547,075 | 7/1925 | Smither | 145/36 UX |
| 1,565,668 | 12/1925 | Nicholls | 145/29 R |
| 2,317,862 | 4/1943 | Stevens | 145/36 |
| 2,377,157 | 5/1945 | Kindland | 145/36 |
| 2,754,863 | 7/1956 | Yearley | 145/29 B |
| 3,129,737 | 4/1964 | Citroen | 145/29 R |
| 3,472,512 | 10/1969 | Berry | 145/36 X |
| 3,753,602 | 8/1973 | Carmien | 145/29 R X |
| 3,819,288 | 6/1974 | Carmien | 145/29 R UX |
| 4,030,847 | 6/1977 | Carmien | 145/29 R X |

FOREIGN PATENT DOCUMENTS

| | | | |
|---|---|---|---|
| 830030 | 1/1952 | Fed. Rep. of Germany | 145/29 A |
| 846702 | 8/1960 | United Kingdom | 145/29 R |
| 996383 | 6/1965 | United Kingdom | 145/36 |

*Primary Examiner*—Harold D. Whitehead
*Attorney, Agent, or Firm*—Krass & Young

[57] ABSTRACT

An all-metal hammer, in which the head is joined to a lightweight, high-strength handle constructed of a suitable metal alloy such as high-strength aluminum by a metal adapter doweled to the handle end and secured to the hammer head by a mating taper, with a shoulder at one end of the adapter and a locking ring secured to the handle at the other end producing a very secure retention of the hammer head. Two different forms of the adapter are used, one consisting of adapter sleeve halves pinned to each other and to the hammer handle end by a dowel extending through both adapter halves and the handle end. In the second version, the adapter is of one-piece construction, with the handle being threadably received into a threaded bore formed in the adapter, a dowel extending through the handle end and the adapter to prevent the handle from being rotated out of the threaded bore.

9 Claims, 8 Drawing Figures

Fig-5
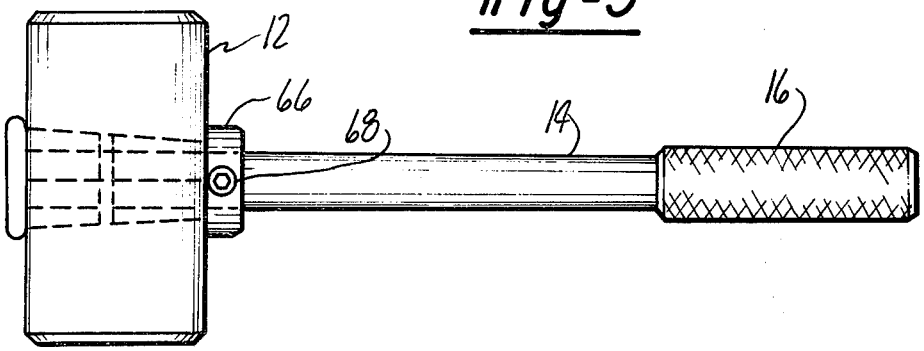
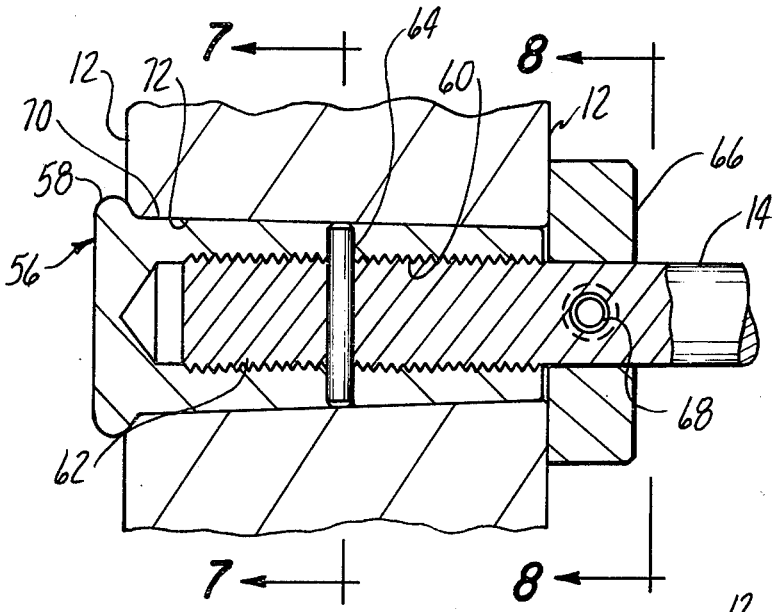
Fig-6
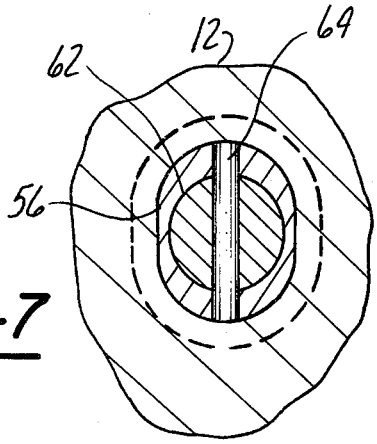
Fig-7
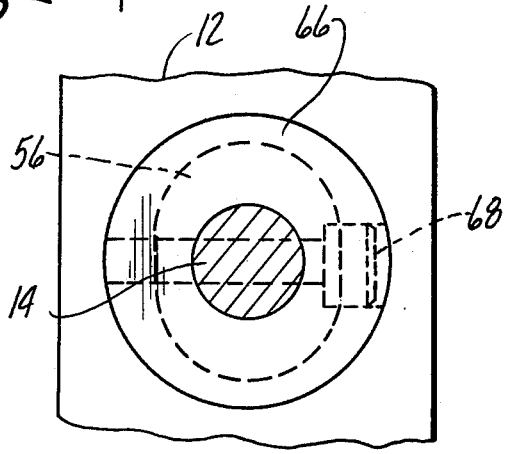
Fig-8

ALL-METAL HAMMER HANDLE ADAPTER CONSTRUCTION

BACKGROUND OF THE INVENTION

1. Field of the Invention

This invention concerns striking instruments such as hammers and more particularly hammer constructions in which the handle and head are constructed separately and are assembled together.

2. Background Discussion

Hammers and other striking tools such as axes, mattocks, etc. have long been constructed by joining wooden handles to steel heads by means of an opening formed within the hammer head received in one end of the handle, with a wedge driven into the terminal end of the handle to create a tight engagement of the handle within the head opening. This construction, while adequate for relatively light duty hammers, does have the disadvantage that the absorption of moisture on the wood handle creates a tendency for the hammer head to become loosened requiring resetting of the wedges or replacement of the handle. In addition, in heavy-duty commercial use of such hammers, such as in manufacturing operations or such commercial enterprises as body repair and tire installation shops, the strength requirements are such that there is a high incidence of failure of the wood handles by breakage and the life of such hammers before they become loosened or break is uneconomically short such that replacement of hammers is a significant expense item in such operations.

In addition, these hammers create safety hazards by the head coming loose while in use such as to sometimes result in the hammer head being completely dislodged and thrown from the handle as the hammer is being wielded.

Another approach has involved the use of relatively lightweight handle material such as of a fiberglass handle joined to the metal hammer head, as by the use of adapters which secure the fiberglass handle to the head by tapered sleeves cooperating with the formed opening in the hammer head. The taper direction is such as to resist the tendency for the hammer head to be dislodged outwardly from the handle during use. Such an approach is described in U.S. Pat. Nos. 3,753,602 and 3,819,288. However, in the aforementioned heavy-use situation, the material used for the adapters, i.e., plastic resinous material, tends to become worn relatively quickly which allows loosening of the hammer head and a high incidence of failure after only relatively short periods of use.

While an all-metal or one-piece hammer construction would eliminate such problems, the cost of constructing a one-piece all-metal hammer would be excessive since the entire hammer must then be drop forged due to the fact that all portions of the hammer must then be of the same strength as the head. Since there is a large number of different head configurations, drop forge tooling wouuld be required for each. In addition, the weight of the hammer would be adversely affected since the handle portion would then be of necessity formed of steel such as to render the hammer relatively unwieldy.

While other hammer construction methods have been utilized, they generally have suffered from the drawbacks described above, i.e., either are not sufficiently durable under heavy-duty use to result in an uneconomically short useful lives and the incidence of hazardous failures, or are of overly costly construction.

It is accordingly an object of the present invention to provide a hammer construction which is extremely durable and which reduces the incidence of failure by separation of the hammer head and handle portion to an absolute minimum.

It is yet another object of the present invention to provide such a hammer construction which may be manufactured at a relatively modest cost without the necessity of heavy capital investment in forging dies, etc., and yet which may be adapted to hammers having a variety of head configurations.

It is yet another object of the present invention to provide such a hammer construction in which the non-striking portions of the hammer are relatively light in weight while being of relatively great strength and durability.

It is still a further object of the present invention to provide such a hammer construction which is of a relatively simple design and easily manufactured.

SUMMARY OF THE INVENTION

These and other objects of the present invention, which will become apparent upon a reading of the following specification and claims, are accomplished by a hammer or other striking tool construction comprised of all-metal components, which are assembled together, including a lightweight but high-strength handle fabricated from a metal such as a high-strength aluminum alloy, a conventional steel hammer head and a metal adapter. The metal adapter secures the handle to the head and is formed either in one piece or of split halves, both having an outside tapered mating with a tapered opening formed in the hammer head. A shoulder formed on the outer end of the adapter and a locking ring secured to the handle retains the hammer head and adapter securely fastened to each other and the hammer handle. In the one-piece adapter version, the hammer handle is threaded into an interior bore formed in the adapter and doweled thereto, while in the sleeve halves adapter, the adapter halves are doweled together and into the handle to provide a tight fit between the handle and adapter and the adapter and the hammer head. The adapter may be made of steel, brass or other suitable metal, and is oblong in section so as to prevent relative rotation between the head and the adapter.

DESCRIPTION OF THE DRAWINGS

FIG. 5 is a side elevational view of an alternate embodiment of the hammer construction according to the present invention.

FIG. 6 is an enlarged sectional view of the end portion of the hammer shown in FIG. 5 showing the details of the connection of the hammer handle, adapter and head.

FIG. 7 is a view of the section 7—7 taken in FIG. 6.

FIG. 8 is a view of the section 8—8 taken in FIG. 6.

DETAILED DESCRIPTION

Figure 1:
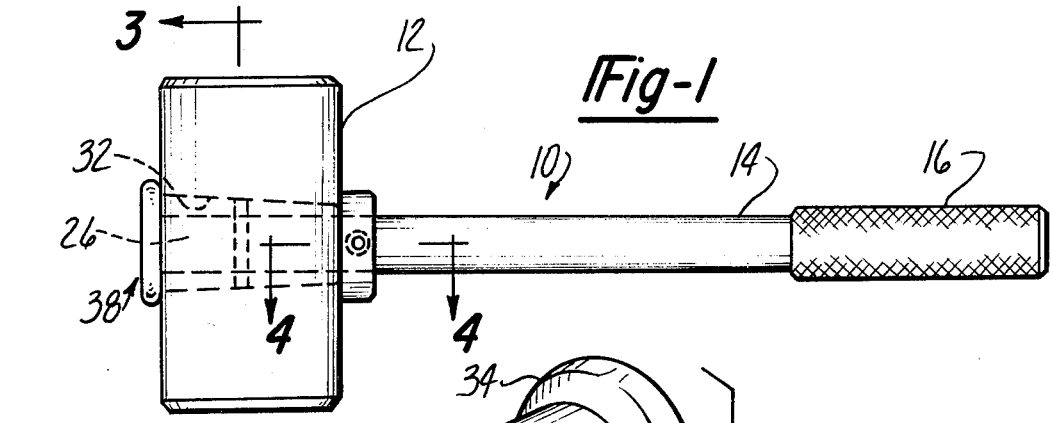
FIG. 1 is a side elevational view of a hammer according to the present invention.
Figure 2:
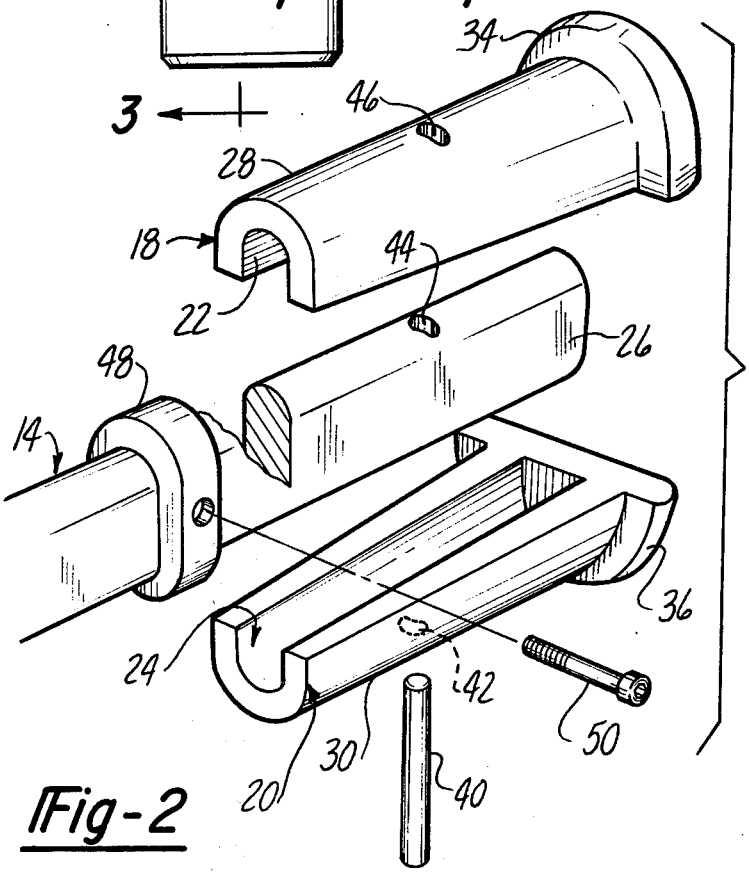
FIG. 2 is an exploded perspective view of the handle end portion and the adapter sleeves halves together with the other hammer head mountinng components.

In the following detailed description, certain specific terminology will be utilized for the sake of clarity and a specific embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 1 through 4, a striking tool such as a hammer is depicted shown as a "two-pound" hammer 10. The hammer includes the striking head 12 which is secured to a handle 14 to which is applied suitable grips 16. The hammer head 12 is formed of a suitable hardened steel alloy as per conventional practice.

According to the concept of the present invention, all of the major components are constructed of metal so as to be extremely durable. Accordingly, the handle 14 is contemplated as being formed of suitable lightweight metal alloy which provides adequate strength such as to preclude the breakage of the handle even in heavy-duty use, while not rendering the hammer so heavy as to be unwieldy. Such a suitable material would be comprised of a high-strength aircraft grade aluminum alloy.

The handle 14 is provided by an elongated member constructed from solid bar stock of a suitable aluminum alloy. One end 26 of the metal handle 14 is secured to the hammer head 12 by an adapter arrangement shown in FIGS. 2 and 3 so as to insure the maintenance of a tight fit between the hammer head and the adapter, and the handle end 26, respectively, so as to preclude any relative movement or loosening of the hammer head 12 and the handle end 26. Loosening of the parts of course leads to increased stress on the mating parts such as to increase the tendency for failure of the securement of the handle head to the handle 14, as well as rendering the hammer 10 unfit to use.

The adapter arrangement according to the embodiment shown in FIGS. 1 through 4, is a split sleeve construction provided by a pair of adapter sleeve halves 18 and 20, each having an inside recess 22 and 24, respectively, adapted to form an opening when assembled together to mate with a complementary shaped end portion 26 of the hammer handle 16. The outer contour 28 and 30 of the adapter sleeve halves 18 and 20, respectively, in turn is configured to mate with the tapered opening 32 formed in the central region of the hammer head 12. The tapered opening mates with the resultant tapered surface provided by the outer contours 28 and 30 when the adapter sleeve halves 18 and 20 are assembled onto the end portion 26 of the hammer handle 16. The tapering configuration or engagement of the adapter split sleeves 18 and 20 on the interior central bore 32 is designed to produce a tight fit between the hammer head 12 and the sleeves 18 and 20 and by compression of the sleeve halves 18 and 20 to produce a tight fit between the recesses 22 and 24 thereof. Thus, the assemblage insures a tight interfitting of the respective components. The adapter sleeve halves 18 and 20 themselves are also designed to be constructed of a metal material although the strength characteristics are not highly critical as long as a suitably durable metal such as iron, steel or brass is selected.

Figure 3:
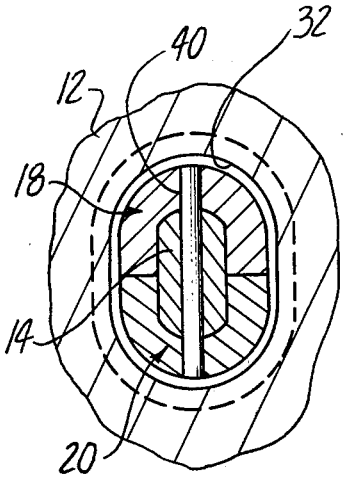
FIG. 3 is a view of the section 3—3 taken in FIG. 1.
Figure 4:
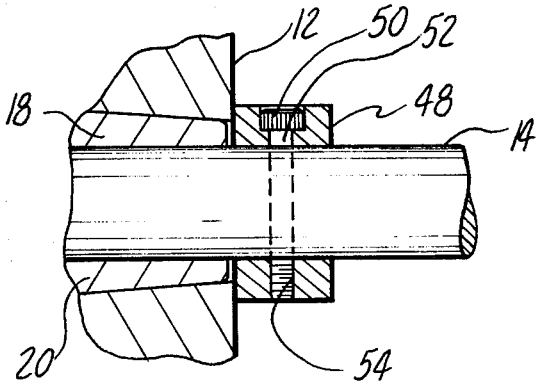
FIG. 4 is a view of the section 4—4 taken in FIG. 1.

The outer contour of the adapter sleeve halves 18 and 20 when assembled is noncircular or oblong in section as seen in FIG. 3, with the tapered opening 32 being similarly configured such as to preclude any rotation of the hammer head 12 on the adapter sleeve halves 18 and 20. The noncircular or oblong shape in section of the handle end 26 as well as the recesses 22 and 24 when the adapter sleeve halves 18 and 20 are assembled, in turn insures no rotation of the adapter on the handle end 26.

The adapter sleeve halves 18 and 20 are also formed at either end with a protuberance 34 and 36, respectively, which when the adapter is assembled, forms a shoulder 38, which affords an abutment retention of the hammer head 12 against outward movement of the hammer head 12 which is in addition to the restraining effect of the taper direction being larger at the hammer handle end 26 and smaller at the inside edge. This combined effect provides a very positive and safe retention of the hammer head 12 with the metal utilized to construct the sleeve halves 18 and 20, providing a very durable impact resistant characteristic thereof.

The split sleeve and the handle portion 26 are secured together by a transversely extending dowel pin 40 which passes through a hole 42 in the lower sleeve 20 transversely through the handle portion 26 and a hole 46 in the upper sleeve 18. Once the hammer head is assembled onto the adapter sleeves 18 and 20, the dowel pin 40 is prevented from shifting or being dislodged due to engagement with the interior of the tapered bore 42 formed in the hammer head 12.

The hammer head 12 is prevented from being withdrawn from the tapered adapter sleeve halves 18 and 20 by means of a safety ring 48 preferably constructed of steel or aluminum which is secured in an abutting position against both secured on the handle 14 against the hammer head 12 and the adapter sleeve halves 18 and 20 at their inside edge by means of a cap screw 50 extending transversely through the ring 48, the cap screw 50 passing through a counterbore opening 52 on one side of the ring 48 and a threaded bore 54 formed on the other side of the ring 48. The adapter sleeve halves 18 and 20 are of a length such as to be flush or recessed with the hammer head inside surface adjacent the opening 32 so as to insure proper abutting engagement of the ring 48 with the hammer head 12.

The safety ring 48 is very securely retained on the handle 60 with the hammer head 12 and thus positively prevented from movement in either direction such as to create dislodging or loosening of the hammer head 12 from the handle 14.

It can be appreciated that this arrangement provides a very secure and durable joinder of the hammer head 12 to the hammer handle 14 since it is of an all-metal construction. In addition, it offers positive failsafe retention of the hammer head 12 on the handle 14 by virtue of the safety ring 48 and the shoulder 34, as well as the use of the dowel pin 40. At that same time, the hammer may be of optimal handling characteristics while having very adequate strength characteristics by virtue of the use of a lightweight, but high-strength aluminum alloy material for the handle portion 14, while using the conventional steel hammer head 12. This construction also allows the use of the handle 14 and adapter assembly to heads of varying configuration or for other striking tools such as axes, hatchets, mattocks, sledges, etc. without the need for heavy capital investment in equipment such as forging dies for each tool of a different configuration. All this has been accomplished by a relatively simple design which should insure that the hammer 10 will last almost indefinitely due to its extremely durable construction features.

According to FIGS. 5 through 8, an alternate embodiment of the hammer construction according to the present invention is disclosed. This embodiment similarly includes a handle 14 secured to the hammer head 12 with a grip portion 16 secured to the lower end of the handle 14. However, as seen in FIGS. 6 through 8, rather than a split sleeve adapter, a one-piece socket adapter 56 is provided which has an enlarged protuberance 58 providing a shoulder 58 as in the above-described embodiment.

The handle 14 is secured to the adapter socket 56 by threaded engagement with an internally threaded bore 60 formed within the socket adapter 56. The handle 14 is of round cross section in this instance and has an outer externally threaded portion 62 which is rotated into the socket adapter threaded bore 60. After assembly, a transverse passage is drilled through the assemblage and a dowel 64 inserted to pin together the socket adapter 56 and the threaded portion 62 of the handle 14 to prevent the handle 14 from being rotated out of the bore 60 after assembly, without removal of the dowel 64.

A safety ring 66 is provided similar to the above-described embodiment which is fastened by means of a cap screw 68 threaded into an opposite bore and passing through the hammer handle 14. The safety ring 66 is in abutment against the hammer head 12 to prevent it being withdrawn from the socket adapter 56 after it is seated thereon. The socket adapter 56 has an outside tapered diameter 70 which mates with a similar complementary tapered bore 72 and the hammer head 12 such as to provide tight seating of the hammer head 12 against and on the taper socket 56 which is secured by means of locking rings 66. The socket adapter 56 is oblong in section as is the tapered bore 72 such as to preclude relative rotation therebetween.

In turn, the threaded engagement of the handle end 62 and the presence of dowel 64 insures a tight fit between the threaded portion 64 and the hammer handle 14 and the socket adapter 56. The socket adapter 56 in similar fashion may be constructed of brass or other metal having suitable impact resistance characteristics. The handle 14 is constructed of a high-strength aluminum alloy in the above-described embodiment.

It can be seen that this construction affords the advantages of the above-described embodiment and in addition provides in the one-piece construction of the adapter socket 56 a simplification in some degree of the hammer construction.

While specific materials are disclosed as utilized in the construction of this hammer according to the present invention, it is of course understood that other metal alloys having similar characteristics as described could of course be substituted. However, the combination of the high-strength aluminum alloy and steel head affords a particularly advantageous combination of materials which is accordingly the preferred embodiment of the invention.

It is further contemplated that this hammer construction be of all-metal since only metals provide the combination of characteristics of high durability and strength such as to provide a nearly indestructible hammer having a vastly longer economic life than hammer constructions as heretofore provided. Indeed for many applications, this hammer construction would be of such great durability as to obviate the need for replacement in commercial operations for an almost indefinite time period.

While the construction is of course substantially more expensive than conventional wooden-handled hammers, the factors involved have been found to be such that the present construction is much more economic inasmuch as it proportionately will last longer and eliminates the administrative burden of replacing handtools. Very importantly, it will also almost totally eliminate the hazardous dislodgement of the heads from the hammer handle during use, which subjects such businesses to liability to injured bystanders or employees.

The embodiments of the invention in which an exclusive property or privilege is claimed are defined as follows:

1. A striking tool comprising:

a metal tool head having a noncircular tapering opening extending therethrough;

a metal adapter having a noncircular tapering outer contour shaped complementarily to said tool head opening to mate with said opening formed in said tool head, said metal adapter positioned in said tool head opening in mating engagement therewith, said noncircular shape of said tool head opening and outer contour of said adapter preventing relative rotation therebetween;

said metal adapter further formed with a noncircular internal opening extending along the direction of said taper;

an elongated solid metal handle having one end complementarily shaped in a noncircular shape to mate with said metal adapter internal opening and prevent relative rotation therebetween, said one end mounted into mating relationship with said metal adapter internal opening, extending thereinto from the direction of the small end of said taper of said metal adapter outer contour;

a pin extending transversely to said adapter taper through a transverse opening in said one end of said metal handle through corresponding aligned transverse openings in said metal adapter in portions of said metal handle and metal adapter disposed within said opening in said tool head;

a safety ring secured to said handle in abutment against said metal tool head, proximate said smaller diameter portion of said tapering contour, whereby said tool head is prevented from movement relative said adapter sleeve halves and said handle portion and said pin is prevented from being dislodged by said tool head.

2. The striking tool according to claim 1 wherein said metal handle is constructed of a high-strength aluminum alloy and wherein said tool head is constructed of steel.

3. The striking tool according to claim 2 wherein said metal adapter comprises a pair of metal adapter sleeve halves positioned together to form said adapter, each of said adapter sleeve halves having an inner recess adapted to form said adapter opening with said adapter halves positioned together and receiving said handle end portion with said adapter sleeve halves assembled on said handle one end, and wherein each of said adapter sleeve halves is formed with said outer tapered contour mating with said metal tool head opening with said sleeve halves assembled together onto said one end of said metal handle.

4. The striking tool according to claim 3 wherein each of said adapter sleeve halves is formed with a shoulder at one end thereof proximate the larger end of said tapered outer contour, whereby said metal tool head is further secured against dislodgement from said metal adapter by said shoulders formed thereon.

5. The striking tool according to claim 2 wherein said metal adapter comprises a tapered socket and wherein said adapter opening comprises an internal threaded bore formed in said socket adapter and wherein one end of said metal handle includes a threaded portion thereof threadably received within said threaded bore.

6. The striking tool according to claim 5 wherein said socket adapter is formed with a shoulder at one end thereof proximate the larger end of said tapered contour, whereby said tool head is further secured against dislodgement from said socket adapter by said shoulder formed thereon.

7. The striking tool according to claim 6 further including a safety ring disposed on said handle in abutment against said tool head, proximate said smaller end of said tapering contour, whereby said tool head is prevented from movement relative said socket adapter and said handle portion.

8. The striking tool according to claim 5 wherein said metal handle is formed of a high-strength aluminum alloy and wherein said tool head is formed of steel.

9. The striking tool according to claim 7 wherein said metal handle is formed of a high-strength aluminum alloy and wherein said tool head is formed of steel.

* * * * *